US008006464B2

(12) United States Patent
Krulitsch

(10) Patent No.: US 8,006,464 B2
(45) Date of Patent: Aug. 30, 2011

(54) BEVERAGE BOTTLING PLANT FOR FILLING BOTTLES WITH A LIQUID BEVERAGE FILLING MATERIAL, HAVING AN APPARATUS FOR EXCHANGING OPERATING UNITS DISPOSED AT ROTATING CONTAINER HANDLING MACHINES

(75) Inventor: Dieter-Rudolf Krulitsch, Bad Kreuznach (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 1000 days.

(21) Appl. No.: 10/931,817

(22) Filed: Sep. 1, 2004

(65) Prior Publication Data

US 2005/0086909 A1 Apr. 28, 2005

(30) Foreign Application Priority Data

Sep. 2, 2003 (DE) ..... 103 40 365

(51) Int. Cl.
*B67B 1/04* (2006.01)
*B65B 1/06* (2006.01)

(52) U.S. Cl. ..... 53/253

(58) Field of Classification Search ..... 53/253, 53/331.5, 317, 319
See application file for complete search history.

(56) References Cited

U.S. PATENT DOCUMENTS

| | | | | |
|---|---|---|---|---|
| 5,713,403 | A * | 2/1998 | Clusserath et al. | 141/101 |
| 5,778,633 | A * | 7/1998 | Sweeny | 53/201 |
| 6,276,113 | B1 * | 8/2001 | Bernhard | 53/253 |

FOREIGN PATENT DOCUMENTS

| | | | |
|---|---|---|---|
| DE | GM 72 18 143 | | 9/1975 |
| DE | 25 53 989 | | 8/1976 |
| DE | 27 47 501 | | 4/1979 |
| DE | 32 27 244 | C1 | 5/1984 |
| DE | 198 40 172 | A1 | 9/2000 |
| EP | 405402 | A2 * | 1/1991 |

* cited by examiner

*Primary Examiner* — Rinaldi I. Rada
*Assistant Examiner* — John Paradiso
(74) *Attorney, Agent, or Firm* — Nils H. Ljungman & Associates

(57) ABSTRACT

An apparatus for exchanging operating units disposed at rotating container handling machines, particularly upper handling components for varying the filling program, the cleaning program, and/or the closing program, wherein units are removed and replacement units are mounted in place of the removed units, it being proposed that each upper operating head (for example, filling element) {4} is associated with a plurality of replacement units {18, 19, 20} and these replacement units can be attached during a replacement at all operating heads {4} at the same time and/or exchanged at the same time and/or can be brought into the operative position with/connected to these operating heads {4}. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

17 Claims, 5 Drawing Sheets

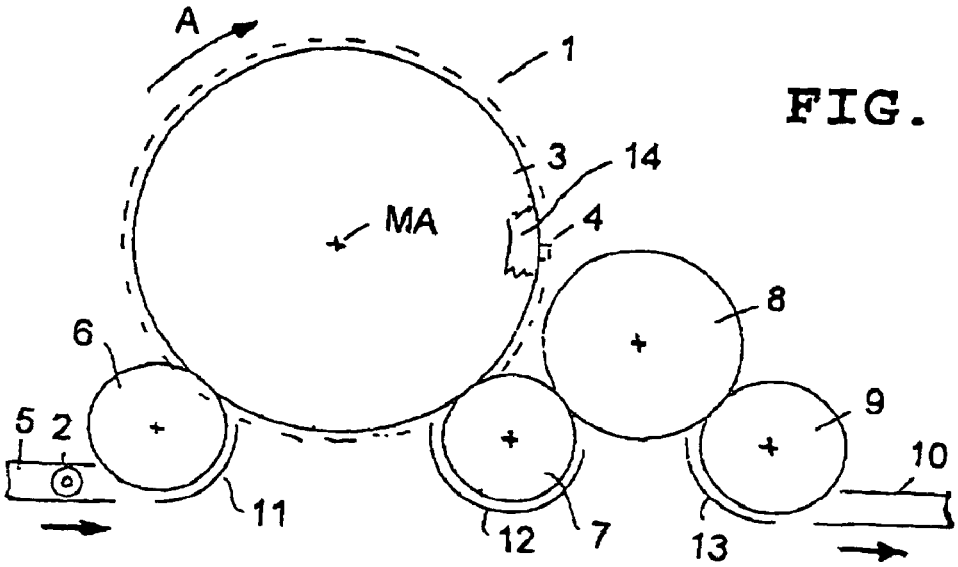
FIG. 1
FIG. 2
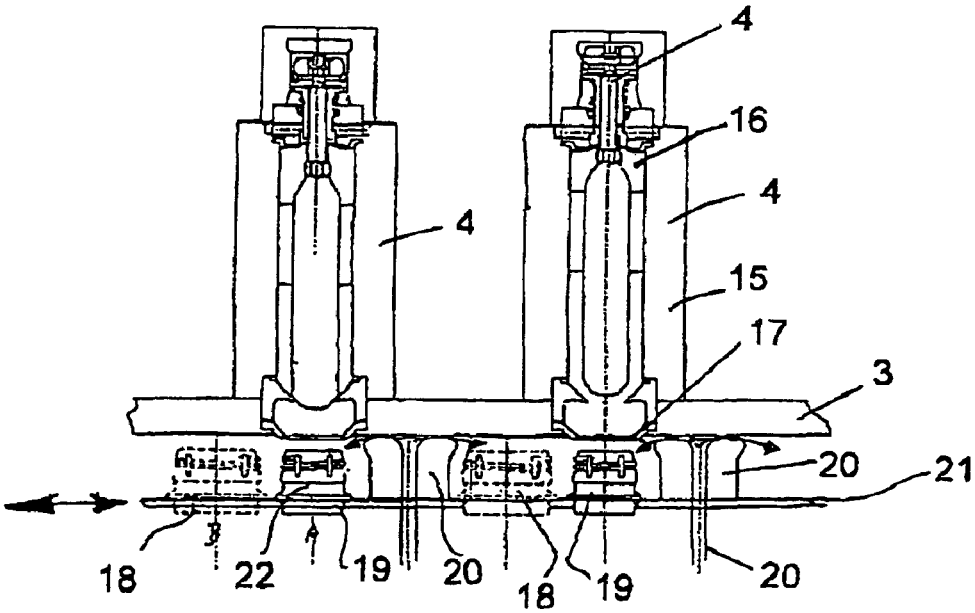

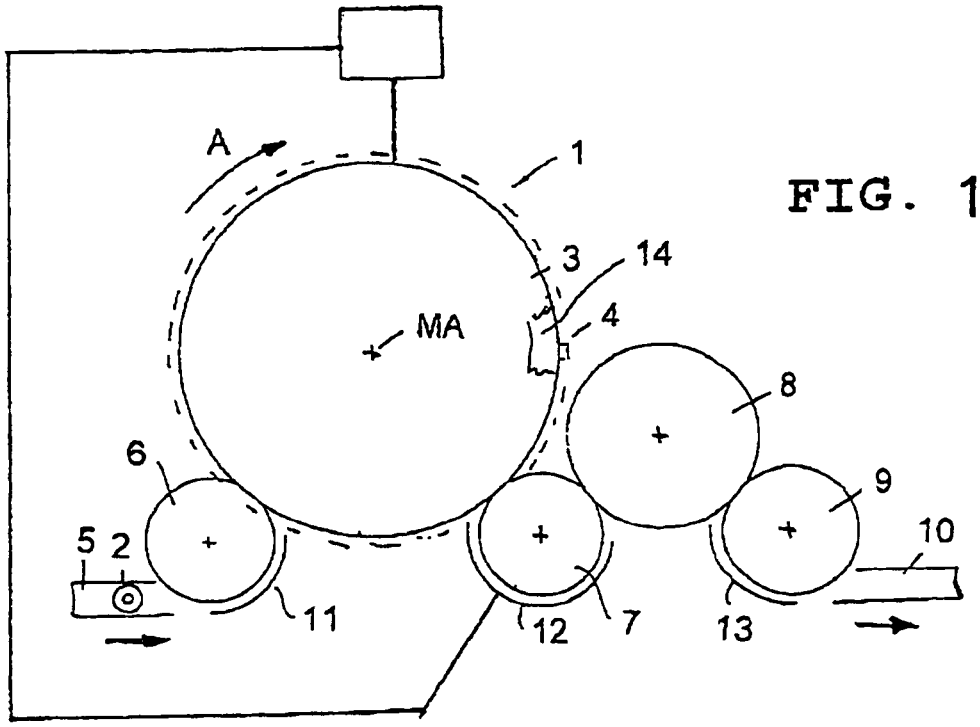
FIG. 1B
FIG. 2A
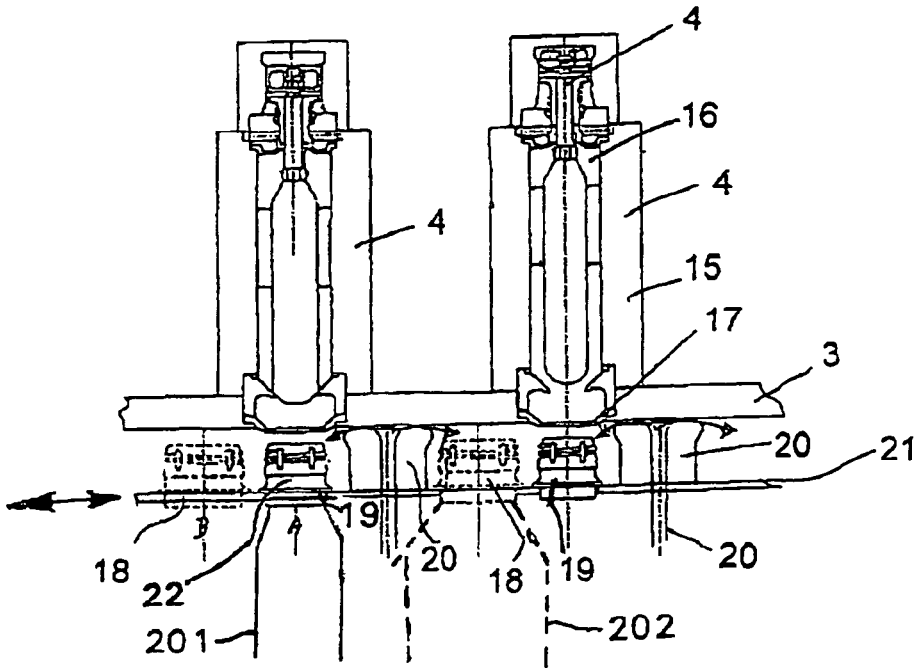

BEVERAGE BOTTLING PLANT FOR FILLING BOTTLES WITH A LIQUID BEVERAGE FILLING MATERIAL, HAVING AN APPARATUS FOR EXCHANGING OPERATING UNITS DISPOSED AT ROTATING CONTAINER HANDLING MACHINES

BACKGROUND

1. Technical Field

The present application relates to an apparatus for exchanging operating units, particularly handling head components, that are disposed at rotatable container handling machines, and that can be exchanged for carrying out filling programs, cleaning programs and/or closing programs, with the individual operating units being removed and replaced by other operating units.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

In filling machines it is required to replace certain operating units at the handling heads. These comprise, for example, filling conduits, flushing or rinsing container, and the like. Particularly in the case of mechanical filling machines for filling beverages, when the filling height is essentially determined by the lower end of a short filling tube, it is necessary to replace the filling tube for different filling heights. Generally, these short filling tubes, (in the case that they are provided with a screw thread), are removed by unscrewing from the filling head or, respectively, handling head and they are replaced by corresponding filling tubes of another length. For a corresponding plug-in type connection of such filling tubes it has already become known to remove the filling tube by means of a pneumatic removal apparatus that is correspondingly manually actuated.

In an arrangement according to German Patent No. 19 840 172 A1 there is provided an automated mounting and exchange arrangement that can be moved into different positions, with which automated mounting and exchange arrangement the operating units can be mounted at the handling heads, can be removed therefrom, and can be moved into a storage position, and other operating units can be moved from their storage position and can be connected to the handling heads, with the automated mounting and exchange arrangement removing segments of the container handling machine in automated manner and correspondingly completes an exchange of an operating unit at least one of a number of handling heads that are disposed adjacent to one another.

The automated mounting and exchange arrangement carries out, subsequent to a rough positioning of the handling machine, an own or inherent precise positioning with respect to the handling machine, and subsequently the automated mounting and exchange arrangement carries out the exchange of the operating units.

The automated mounting and exchange arrangement comprises at least one mounting unit for one exchangeable component, or for a plurality of exchangeable components, and the automated mounting and exchange arrangement can be brought in sections into a position of agreement with the filling valves that are disposed in a circular pattern, and the automated mounting and exchange arrangement exchanges a plurality of air tubes while in the exchange position.

The individual operating procedure for exchange of operating units that are disposed at rotatable handling machines comprises the following steps:

- moving of sections of the rotor of the handling machine with subsequent rough positioning;
- fine positioning of the mounting unit at the handling head with removal of the operating unit and depositing thereof in a storage unit;
- removing at least one operating unit from a storage unit with subsequent positioning and securing of the operating unit at at least one handling head;
- determining at least one further operating position of the automated mounting and exchange arrangement and/or fine positioning into a further sector of the rotor of the handling machine that is configured to rotate in sectors.

It is clear that such an exchange entails a considerable number of operating steps and a corresponding time consumption, even in the case of the improved prior art.

In the cleaning of such filling machines or, respectively, the handling heads thereof, if is furthermore known that the flushing or rinsing containers, that are correspondingly configured for the cleaning procedure, are individually connected to the handling heads. In this, a delivery arrangement that is configured to be brought from the exterior of the circular periphery of the filling machine is brought into a delivery position at the circular course of the filling machine, and subsequently the individual rinsing or flushing containers are brought into a fixed position, are secured to the handling stations, and are moved with the filling machine along the circular course of the filling machine. Upon completion of the flushing or rinsing cycle, the flushing or rinsing containers are separated from the handling stations by the delivery arrangement and they are placed at a location outside of the circular course of the filling machine, that is, outside of the reach of container handling machine.

In order to achieve an improvement in this procedure and arrangement, it has already been proposed that securing of the flushing or rinsing containers at the filling elements is carried out without additional means and essentially automatically, with the holding of the flushing or rinsing container beyond the exit region of the bottles being maintained, and it only being necessary to disrupt the action of the bleeder valve during the flushing or rinsing cycle. At the same time, there is also postulated in this prior art arrangement that the pressure prevailing in the filling machine is utilized in such a way that the connection of the flushing or rinsing container at the filling machine as such is maintained. (DE 23089190 C3, DE 2747501 C3, DE 3227244 C1, and DE-GM 7218143). With these known suggestions there is already achieved an essentially easier operation of the daily cleaning of such filling machines. The individual flushing or rinsing containers are moved, from a parked position at an exterior position with respect to the filling machine, onto a belt conveyer for the bottles to be filled and are delivered into the machine. Upon being brought into the circular course of the filling machine there is then carried out, by lifting of the lifting elements, also the lifting of these flushing or rinsing containers against the filling valve, with an automatic attaching of the containers at the components of the filling elements being achieved. The containers may then traverse the circular course several times and upon conclusion of the filling, they can the be removed from the machine. For this, the flushing or rinsing container is rendered pressure-less and is brought by the lifting elements again to the lower removal level of the exit conveyer.

Finally, it is known to leave the flushing or rinsing containers in the machine per se and to move them by independent lifting arrangements, that are located outside of the lifting elements that serve to lift the bottles, against the filling elements (DE 2553989 B2). As a consequence, in this known arrangement, further lifting elements are necessary for moving the flushing or rinsing containers and this is substantially adding to the entire complex machinery arrangement and the control thereof with a filling machine being complex in any way. Additionally, the further lifting elements need to be located at an appreciable distance away from the centers of the filling valves axes, per se, and therefore appreciable support problems arise during the subsequent flushing or rinsing operation.

The exchange process that needs to be done from the exterior at such container handling machines and the filling heads and handling heads thereof leads to considerable disadvantages when using aseptic filling systems, since the interiors of the clean chambers need to be entered.

OBJECT OR OBJECTS

The present application has as its aim, while avoiding the mentioned disadvantages, to allow a substantially more rapid and simplified exchange/adaptation of the handling machines and filling machines when changing of the filling program or cleaning program, or upon change to other bundling sizes or mouth sizes of the containers that are to be filled and/or to be closed, and also particularly entry from the exterior, in the case of aseptic handling methods, into the interior of the clean chambers, or into machines that have such handling sections and handling zones of chambers of the clean-room type, is to be minimized.

SUMMARY

The aim that is anterior to the present application, is accomplished in a container handling machine of the mentioned class by the elements enumerated herein below.

The primary advantage of the present application resides therein that now the exchange of handling components, such as, support devices, centering devices, holding devices and neck/collar support devices, and the like, as well as flushing or rinsing containers, or flushing or rinsing conduits, and flushing or rinsing nozzles can be can be carried out automatically with a single exchange procedure by or, respectively, at all handling heads of such a container handling machine.

There is particularly achieved a substantial saving of time when such exchange procedures are carried out, particularly when often substantially more than one hundred operating heads and/or filling positions are present.

Furthermore, in the case of closed chambers or chamber components of such handling machines or in the case of their arrangement in special aseptic rooms, an entry from the exterior into the interior is no longer required.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below with reference to the exemplary embodiments illustrated in the accompanying drawings, in which:

FIG. 1 shows a simplified presentation and in top plan view a container handling machine that is configured as a filling machine together with a closing machine that is connected to the filling machine;

FIG. 1B is similar to FIG. 1 and shows a control unit attached to the container handling machine;

FIG. 2 shows the upper portion of a filling machine with a rotatable carrier for the operating heads and/or filling valves and a support arrangement for the various exchange components;

FIG. 2A is similar to FIG. 2 and shows bottles attached to the various exchange components;

DESCRIPTION OF EMBODIMENT OR EMBODIMENTS

Developments, advantages and potential applications of the embodiments are described below with reference to the exemplary embodiments illustrated in the accompanying drawings. All the features described and/or illustrated are the object of the present application, individually or in any possible combination, regardless of their placement in the claims or the references to other claims. The content of the claims is also an integral part of the description and is hereby incorporated by reference.

Figure 1A:
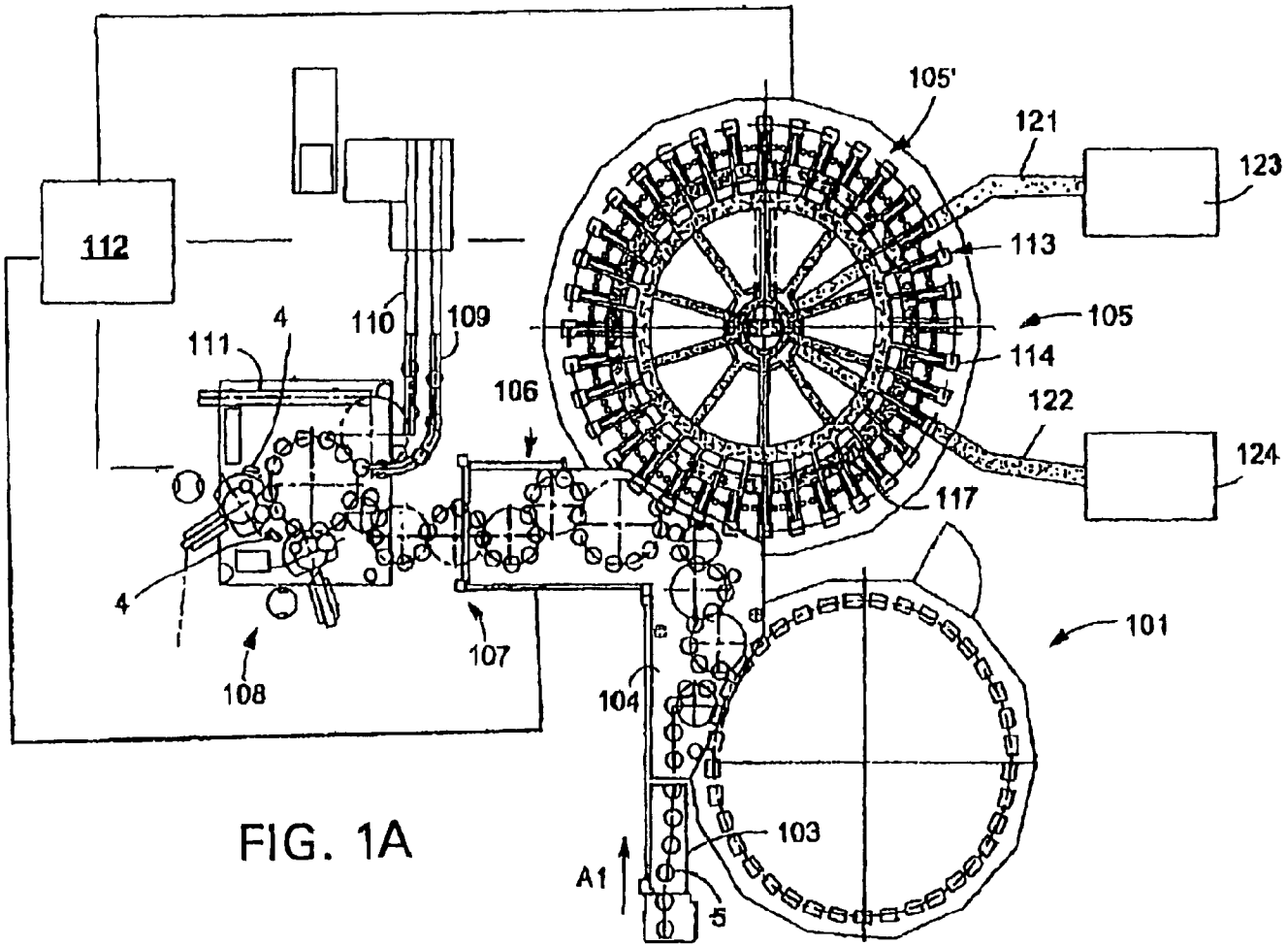
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinsing arrangement or rinsing station 101, to which the containers, namely bottles B, are fed in the direction of travel as is indicated by the arrow A, by means of a conveyer line or conveyer arrangement to feed bottles to rinsing arrangement 103, and downstream of rinsing arrangement or rinsing station 101, in the direction of travel as is indicated by the arrow A, the rinsed bottles B are transported to a beverage filling machine 105 by means of a conveyer line or conveyer arrangement to pass bottles to filling machine 104 that is formed, for example, by a starwheel conveyer or a plurality of starwheels of a conveyer arrangement. The conveyer arrangement to pass bottles to filling machine 104 may possibly comprise a starwheel conveying structure 104*a* that introduces bottles B to the filling machine 105.

Downstream of the filling machine 105, in the direction of travel of the bottles B, there can preferably be a closing arrangement or closing station 106 which closes the bottles B.

The closing arrangement or closing station 106 can, for example, be connected directly to a labeling arrangement or labeling station 108 having at least one labeling unit, device, or module for first product 108*a*, each unit having a head, such as, for example, by means of a conveyer arrangement to pass bottles to labeling arrangement 107 that may be formed, for example, by a plurality of starwheels of a conveyer arrangement.

In the illustrated embodiment, the labeling arrangement or labeling station 108 having at least one labeling unit, device, or module for first product 108*a*, each unit having a head has, for example, three outputs, namely one output formed by a conveyer arrangement to convey first product bottles 109 for bottles B that are filled with a first product. The first product may possibly be provided by a first product mixer 123 that is connected to the filling machine 105, for example, through a conduit for first product 121, and bottles B that are filled with a predetermined volume of liquid beverage filling material, that is, the first product, are then labeled by a labeling module 126 in the labeling arrangement or labeling station 108 having at least one labeling unit, device, or module for first product 108*a*, each unit having a head, corresponding to this first product delivered from first product mixer 123 to the beverage filling machine 105 and thence to the corresponding bottles B. One embodiment of a labeling station, or labeling machine, is described in greater detail herein below with reference to FIG. 1.

A second output that is formed by a conveyer arrangement to convey second product bottles 110 is provided for those bottles B that are filled with a second product. The second product may emanate from a second product mixer 124 that is connected, for example, through a conduit for second product 122 to the filling machine 105, and these bottles B filled with a predetermined volume of liquid beverage filling material comprising the second product are then correspondingly labeled by a labeling module 126' in the labeling arrangement or labeling station 108 having at least one labeling unit, device, or module for first product 108*a*, each unit having a head, corresponding to this second product.

A third output, for example, formed by a conveyer arrangement to convey incorrectly labeled bottles 111, removes any bottles B which have been incorrectly labeled as may have been determined by an inspecting device or an inspecting station, or an inspecting module 128 that may possibly form a part of the labeling arrangement or labeling station 108 having at least one labeling unit, device, or module for first product 108*a*, each unit having a head.

In FIG. 1A item 112 is a central control arrangement or, expressed differently, a controller with a computer to process algorithms, which controls the operation of the above-referenced system or plant.

The beverage filling machine 105 is preferably of the revolving design, with a rotor 105', which revolves around a vertical machine axis. The rotor 105' is designed to handle the bottles B by the neck, and is described further herein below with respect to FIGS. 1-4. A filling arrangement 114 having at least one filling device, element, apparatus, or valve 114*a* comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, the filling arrangements 114 having at least one filling device, element, apparatus, or valve 114*a*, are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product, that is, product mix 1, for example.

As well as the more typical filling machines having one toroidal vessel, it is possible that in at least one possible embodiment a filling machine could possibly be utilized wherein each filling arrangement 114 having at least one filling device, element, apparatus, or valve 114*a* is preferably connected by means of two connections to a toroidal vessel 117 which contains a first product, say by means of a first connection, for example, the conduit for first product 121, and to a second toroidal vessel which contains a second product, say by means of the second connection, for example, the conduit for second product 122. In this case, each filling arrangement 114 having at least one filling device, element, apparatus, or valve 114*a* can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Bottles 2 that are to be filled are passed to the filling machine 1 or, respectively, to the rotor 3 thereof, by way of a conveyer 5 and a delivery star 6 (as required, with a dividing screw 5 that precedes the delivery star). The filled bottles 2 are passed to the posterior closing machine 8, by way of a transfer star 7, which closing machine may be a crown-cap closer machine or a screw-cap closer machine. The filled and closed bottles 2 reach the conveyer 10, by way of an outlet star 9. The reference numerals 11, 12, and 13 identify guide elements that are associated with the stars 6, 7, and 9. The guide elements and the stars may have different configurations. Particularly in the case of handling of plastic bottles there are used neck-portion guide devices and centering devices, as well as pneumatic handlers.

The guide elements or transfer devices 11, 12, and 13 consist essentially of a transfer arm which is fastened in a stationary position on the container handling machine or on its components or other components by means of a fastening device, i.e. so that they do not rotate with the stars 6, 7, and 9.

In one possible embodiment, the transfer arm may be mounted in a stationary position on the stars 6, 7, and 9 of the container handling machine. In an alternate embodiment, the transfer arm may be mounted on its own mounting device, separate from the star 6, 7, and 9, or any other components of the container handling machine.

The transfer arm is a single element that is constructed with a rigid material such as metal or plastic. The transfer arm is rigid, that is, not able to bend or otherwise change shape so that it stays in a uniform, stationary position. Further, the transfer arm comprises at least one part that is not moveable with respect to the other parts of the bottling machine. An example of such a transfer arm may be found in Federal Republic of Germany Patent Application No. 103 45 317.2, filed on Sep. 30, 2003, having inventor Volker Till, and its U.S. equivalent, Ser. No. 10/954,012. Federal Republic of Germany Patent Application No. 103 45 317.2 and its U.S. equivalent, Ser. No. 10/954,012 are hereby incorporated by reference as if set forth in their entirety herein.

The filling machine 1 or, respectively, the rotor 3 of the filling machine, the closing machine 8 or, respectively, the rotor of the closing machine, and the stars 6, 7, and 9, for example, are driven individually with a corresponding individual drive or by a common drive, and configure a common machine block or, respectively, a combined filling machine and closing machine.

The filling machine 1 comprises filling elements 4 that are controlled in mechanical, electrical or, respectively, electronic manner, or in other manners. Such a filling element 4 is illustrated in a very simplified way in FIG. 2 and is also referred to a operating head or unit. Each of these filling elements is disposed at the circumference of an annular vessel 14 that is a component of the rotor 3 and that can provide an annular-shaped interior for the liquid filling material, as well as a chamber for pressurizing gas. In the illustrated embodiment, each filling element 4 comprises among other items a housing 15 that comprises a channel 16 for liquid, which channel is in communication with an annular chamber or a supply conduit and the channel 16 providing an annular exit opening 17 at the lower portion of the housing 5.

Figure 1C:
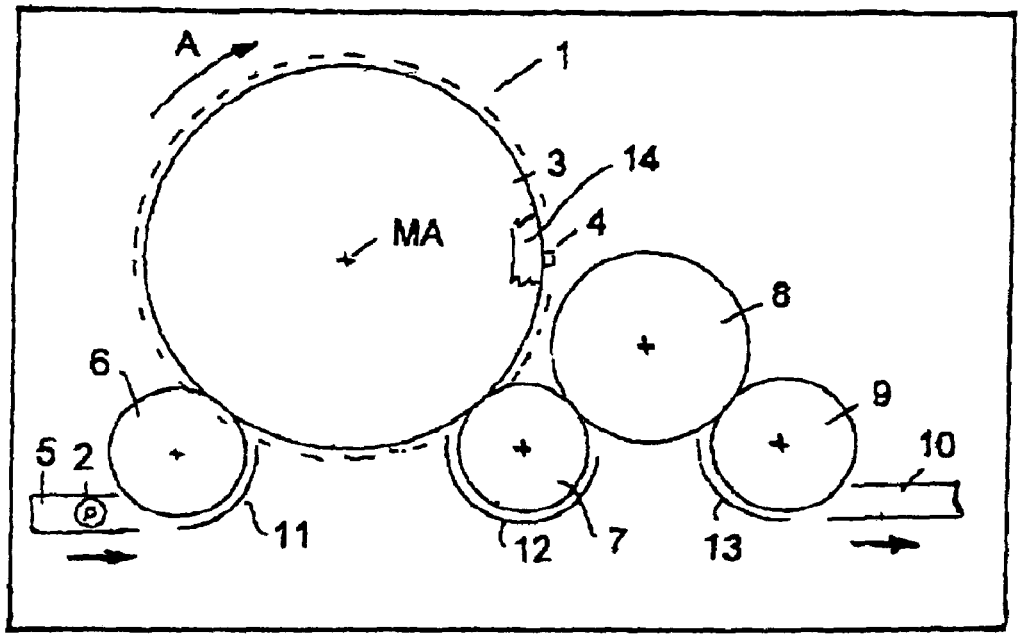
FIG. 1C is similar to FIG. 1 and shows a possible embodiment of a container handling machine with an aseptic filling system, which aseptic filling system is represented by a box around the container handling machine.

FIG. 1C is similar to FIG. 1 and shows a possible embodiment of a container handling machine with an aseptic filling system, which aseptic filling system is represented by a box around the container handling machine. In one possible embodiment, the container handling machine could be enclosed in a closed chamber in a special aseptic room, such as in the aseptic systems found in U.S. Patent Publication No. 20040112460, entitled "Filling machine," and No. 20020083682, entitled "Aseptic bottle filling system," and in U.S. Pat. No. 5,860,461, entitled "Container, a container sealing cap, a process and a machine for cold-aseptic filling with beverages," and U.S. Pat. No. 4,299,853, entitled "Biological preservation of beer."

In accordance with the embodiment illustrated in FIG. 2, the operating heads 4 are configured as free-stream filling elements that do not include lifting of components of the filling elements in the direction of the mouth of the bottles and lowering in the opposite direction filling. Irrespectively, however, any other filling element that performs a lowering movement for being sealingly pressed against the container mouth can be employed. Likewise, a pressing of the container mouths against pressure elements and seal elements of the filling openings can be made, or the use can be made of mobile telescoping pressure arrangements. As is clear from the drawing, a number of exchangeable operating units 18, 19, 20 is associated with each filling element 4, which operating units are disposed, for example, at a rotatable ring structure 21. These exchangeable operating units 18, 19, 20 are configured as different bottle neck supports 18, 19 and/or mouths clamping devices of known configuration, that are not shown in greater detail, as well as flushing or rinsing conduit or flushing or rinsing nozzle 20 for delivery and removal of a circulating cleaning medium.

In FIG. 2, use of the smaller bottle neck support 19 having a centered bottle mouth 22 is illustrated.

When converting to other containers or bottle sizes and/mouth sizes or another program, by way of a simple adjustment or, respectively, rotation of the ring structure 21, the use of the larger bottle neck support 18, or another desired exchangeable component to all the operating heads that are disposed at the rotor or, respectively, the filling elements is assured in a timely manner. The adjustment of the ring structure about the filling machine axis can be accomplished in various ways with the means known in the prior art. There can be employed motorized, electrical, pneumatic or also hydraulic adjustment arrangements or the like, having different or fixed lifting strokes (multi-lifting strokes).

When the exchangeable components are embodied as flushing or rinsing conduit or, respectively, as flushing or rinsing nozzle 20, they are connected by way of a flexible conduit to the supply centers. Special seal arrangements at the flushing or rinsing conduit 20 and/or the lower portion 17 of a filling element ensures a positive sealing of the adjacent components.

Figure 3:
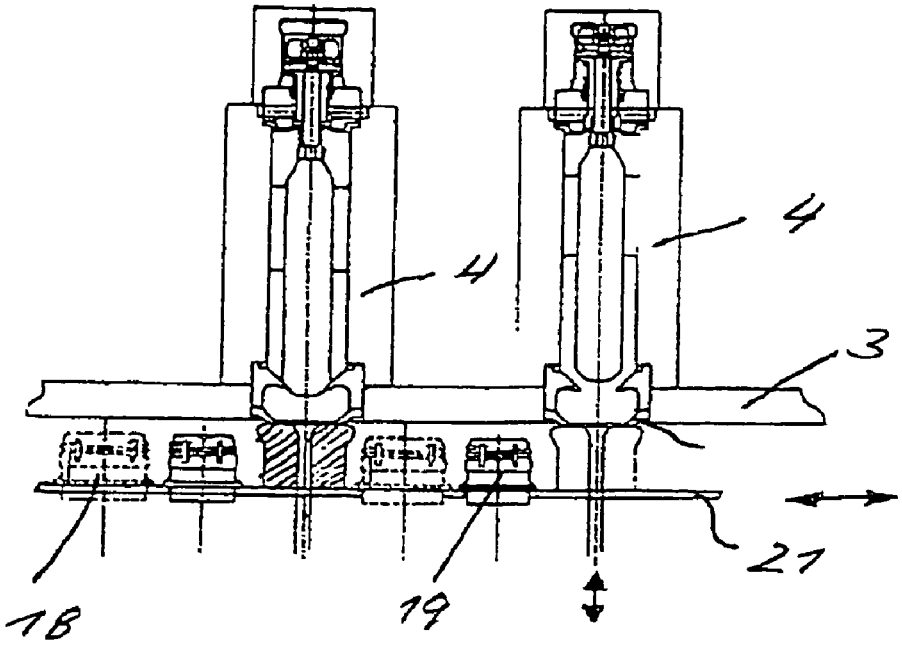
FIG. 3 shows the operating heads with an associated spray nozzle that may also be configured as a container for a flushing or rinsing liquid.

It is also possible to configure the adjustment ring structure 21 as such with an appropriate CIP-channel (CIP-kanal) or, respectively, to dispose a CIP-channel within or at the ring structure 21. However, FIG. 3 shows only in simplified manner the association of one flushing or rinsing nozzle 20 with the filling valve chamber.

Figure 4:
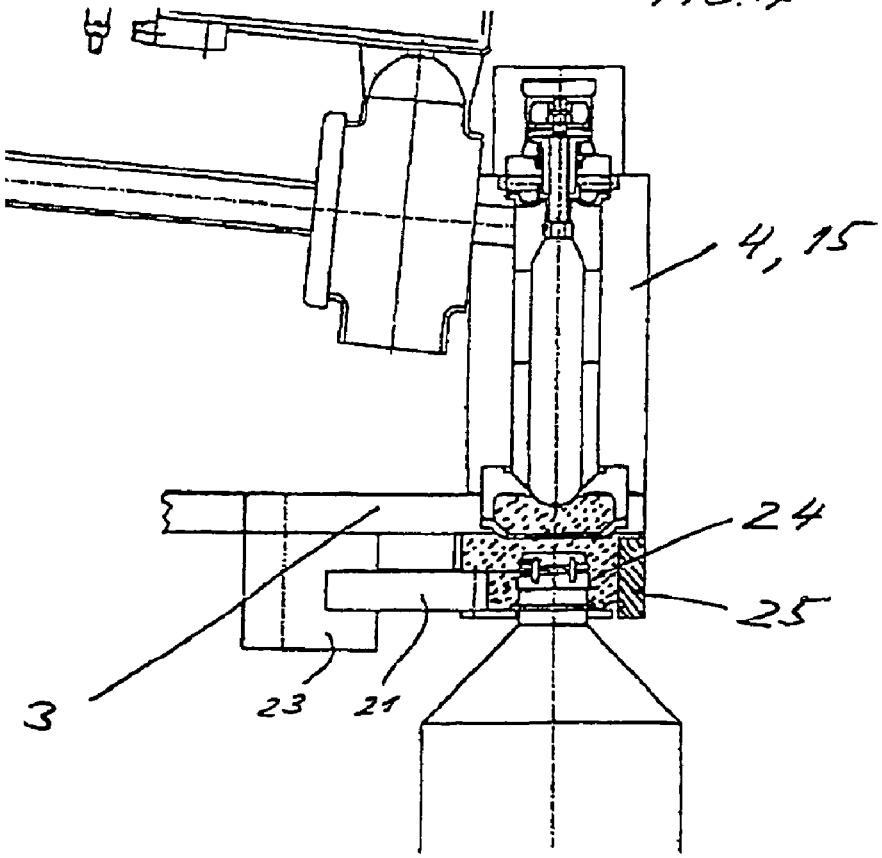
FIG. 4 shows a radial cross-section of an operating head and components of the upper container handling machine with a sterile chamber.

A further variant is shown in FIG. 4, with a radial cross-section of an operating head and components of the upper container handling machine. The ring structure 21 that is rotatable and disposed about the axis of rotation MA of the filling machine configures a sterile compartment 24 that is defined by the inner journal location 23 and the mouth supports, the sterile compartment 24 being partially closed and being disrupted by an outer stationary ring 25 that surrounds the sterile compartment in complementing manner. Sterile gas or another appropriate sterilizing medium can be introduced in various ways into the compartment 24 that is established in this manner.

For example, Federal Republic of Germany Application No. DE 101 45 818.5, entitled "Sterilisiervorrichtung mit H202-Verdampfer," having inventors Holger Grossmann and Thomas Herold, and its U.S. equivalent, having Ser. No. 10/801,924, entitled "Beverage bottling plant for filling bottles with a liquid beverage filling material, and a cleaning device for cleaning bottles in a beverage bottling plant," filed on Mar. 16, 2004, describe a device for cleaning bottles involving the use of hydrogen peroxide. Further, U.S. Pat. No. 6,120,730, entitled "Heat and hydrogen peroxide gas sterilization of container," issued to Palaniappan, et al. on Sep. 19, 2000, teaches a method and apparatus for sterilizing containers with gas-phase hydrogen peroxide and heat on a linear form, fill, and seal packaging machine. Federal Republic of Germany Application No. DE 101 45 818.5, U.S. Ser. No. 10/801,924, and U.S. Pat. No. 6,120,730 are hereby incorporated by reference as if set forth in their entirety herein.

Instead of the adjustment ring structure 21 that is shown in the embodiment for holding the corresponding exchangeable components, it is also within the scope of the application that corresponding adjustment segments are associated with each filling valve. These can be disposed so as to be swung beneath the filling elements 4 together with the exchangeable components. For this, a drive can be provided that adjusts all adjustment segments together by way of an adjustment rod or the like. Such adjustment segments can also be driven by individual servomotors that are appropriately controlled together for exchange of the corresponding exchangeable components.

In another possible embodiment, a first conveyor arrangement 5 moves empty bottles 2 from a bottle preparing station and into a rotatable beverage filling machine 1. The beverage filling machine 1 comprises a rotatable structure 3. The rotatable beverage filling machine 1 further comprises a plurality of beverage filling stations. Each beverage filling station comprises a beverage filling device 4 for filling bottles 2 with liquid beverage filling material.

The filling devices 4 comprise an apparatus being configured to introduce a predetermined volume of liquid beverage filling material into the interiors of the bottles 2 to a substantially predetermined level of liquid beverage filling material. The filling devices 4 are further configured to terminate the filling of beverage bottles 2 upon the liquid beverage filling material reaching the substantially predetermined level in the bottles 2.

The beverage bottling system comprises a star wheel 6, which star wheel 6 is configured to move bottles 2 through said rotatable beverage filling machine 1. The filling machine rotatable structure 3 further comprises a rotatable holding apparatus 21 configured to hold the tops of the bottles 2, at least during filling, in the rotatable beverage filling machine 1. The filling machine rotatable holding apparatus 21 comprises a first set of openings 18 configured to hold and position bottle tops having a first size 201 under their corresponding filling devices. The filling machine rotatable holding apparatus 21 further comprises a second set of openings 19, which second set of openings are a different size than the first set of openings. The second set of openings are configured to hold and position bottle tops having a second size 202, such as three-liter plastic bottles, under their corresponding filling devices. In other words, the filling machine rotatable holding apparatus 21 comprises at least two sets of openings, each set of openings having a different size for holding at least two different size bottles 2, such as two-liter and three-liter bottles. The two sets of openings are configured to hold the bottles 2 beneath their corresponding filling devices to be filled.

The filling machine rotatable structure 21 further comprises a set of cleaning devices configured to be disposed under and to clean at least their corresponding filling devices. A flushing or rinsing nozzle 20 is configured and disposed to be connected by way of a flexible conduit to the supply centers. Special seal arrangements at the flushing or rinsing conduit 20 and/or the lower portion 17 of a filling element ensure a positive sealing of the adjacent components. As illustrated in FIG. 4, the flushing or rinsing nozzle 20 is configured and disposed to be associated with a filling element such that the flushing or rinsing nozzle 20 sprays up into the filling element and effectively flushes the filling element. The flushing or rinsing nozzle 20 is configured and disposed such that it is not disposed directly beneath a filling element, but is still able to spray in order to clean the top surface or other surfaces of the filling machine rotatable structure 21 or any components thereof. In this position, the flushing or rinsing nozzle 20 also sprays upwards to clean the bottom surface of the rotor 3.

The filling machine rotatable holding apparatus 21 is configured to rotate with respect to the filling devices to electively position one of the first set of openings 18, the second set of openings 19, and the cleaning devices or flushing or rinsing nozzles 20, under their corresponding filling devices. The filling machine rotatable holding apparatus 21 is configured to rotate by way of a filling machine rotation arrangement, which filling machine rotation arrangement is configured to rotate and position the rotatable holding apparatus 21 with respect to the filling devices.

A second conveyor arrangement is configured and disposed to move filled bottles 2 from said rotatable beverage filling machine 1 and into a rotatable closing station. The rotatable closing station is configured and disposed to secure bottle closures to bottles 2 and comprises closing devices to close bottles 2. The rotatable closing station comprises a first star wheel 7 configured to move bottles 2 from the filling machine and to the closing station. The rotatable closing station is configured and disposed to secure bottle closures to bottles 2 and comprises closing devices to close bottles 2. The bottle closing station further comprises a rotatable structure 3. The closing station rotatable structure 3 comprises a rotatable holding apparatus 21 configured to hold tops of bottles 2 during bottle closing.

The closing station rotatable holding apparatus 21 comprises a first set of openings 18 configured to hold and position bottle tops having a first size, e.g., a two-liter plastic bottle, to be closed under their corresponding closing devices. The closing station rotatable holding apparatus 21 further comprises a second set of openings 19 configured to hold and position bottle tops having a second size to be closed under their corresponding closing devices. In other words, the closing station rotatable holding apparatus 21 comprises at least two sets of openings, each set of openings having a different size for holding at least two different size bottles 2. The two sets of openings are configured to hold the bottles 2 beneath their corresponding closing devices to be closed.

In one possible embodiment, the openings could be on a rotating disk, having a diameter of, for example, 6-8". The rotating disk could be connected to the rotatable holding apparatus 21, and could be configured to rotate with respect to the rotatable holding apparatus 21 to permit different openings to be exposed at the periphery of the rotatable holding apparatus 21, to receive bottle necks having a number of different sizes and configurations.

The closing station rotatable holding apparatus 21 further comprises a set of cleaning devices or flushing or rinsing nozzles 20 configured to be disposed under and to clean at least their corresponding closing apparatus. A flushing or rinsing nozzle 20 is configured and disposed to be connected by way of a flexible conduit to the supply centers. Special seal arrangements at the flushing or rinsing conduit 20 and/or the lower portion of a closing device ensure a positive sealing of the adjacent components. The flushing or rinsing nozzle 20 is configured and disposed to be connected to a closing device such that the flushing or rinsing nozzle 20 sprays up into the closing device and effectively flushes the closing device. The flushing or rinsing nozzle 20 is configured and disposed such that it is not disposed directly beneath a closing device, but is still able to spray in order to clean the top surface or other surfaces of the closing machine rotatable structure 21 or any components thereof. In this position, the flushing or rinsing nozzle 20 also sprays upwards to clean the bottom surface of the rotor 3.

The closing station rotatable holding apparatus 21 is configured to rotate with respect to the closing devices to electively position one of the first set of openings 18, the second set of openings 19, and the cleaning devices or flushing or rinsing nozzles 20 under their corresponding closing devices. The closing station rotatable holding apparatus 21 is configured to rotate by way of a closing station rotation arrangement, which closing station rotation arrangement may be configured to rotate and position the closing station rotatable holding apparatus 21 with respect to the closing devices.

The beverage bottling plant further comprises a third conveyor arrangement 10, which conveyer arrangement 10 is configured and disposed to move bottles 2 from said rotatable bottle closing station once the bottles 2 have been closed.

One feature or aspect of an embodiment is believed at the time of the filing of this patent application to possibly reside broadly in a beverage bottling plant for filling bottles with a liquid beverage filling material, said beverage bottling plant comprising: a bottle preparing station being configured and disposed to prepare bottles for filling with a liquid beverage; a storage apparatus being configured and disposed to store a liquid beverage filling material; a beverage filling machine being configured and disposed to fill empty bottles with liquid beverage filling material; a conduit arrangement being configured and disposed to supply liquid beverage filling material from said storage apparatus to said beverage filling machine; said beverage filling machine comprising a rotatable structure; said rotatable beverage filling machine also comprising a plurality of beverage filling devices for filling bottles with liquid beverage filling material; said filling devices comprising apparatus being configured to introduce a predetermined volume of liquid beverage filling material into interiors of bottles to a substantially predetermined level of liquid beverage filling material and to terminate the filling of beverage bottles upon liquid beverage filling material reaching said substantially predetermined level in bottles; said beverage bottling plant further comprising: a first conveyor arrangement being configured and disposed to move empty bottles from said bottle preparing station to said rotatable beverage filling machine; a first star wheel arrangement configured to move bottles from said first conveyor arrangement to said first rotatable beverage filling machine; and a rotatable holding apparatus configured to hold tops of bottles at least during filling in said rotatable beverage filling machine; said filling machine rotatable holding apparatus comprising: a first set of openings being configured to hold and position bottle tops having a first size; a second set of openings being configured to hold and position bottle tops having a second size, said second size being different from said first size; and a set of cleaning devices being configured to be disposed under and to clean at least said filling devices; said filling machine rotatable holding apparatus being configured to rotate with respect to said filling devices to electively position one of: said first set of openings; said second set of openings; and said cleaning devices; under their corresponding filling devices; a filling machine rotation arrangement configured to rotate and position said rotatable holding apparatus with respect to said filling devices; a rotatable closing station being configured and disposed to secure bottle closures to bottles; a second conveyor arrangement being configured and disposed to move filled bottles from said rotatable beverage filling machine into said rotatable closing station; said rotatable closing station comprising closing devices to close bottles; said bottle closing station comprising a rotatable structure; said beverage bottling plant further comprising: a second star wheel configured to move bottles from said second conveyor arrangement to said rotatable closing station; and a rotatable holding apparatus configured to hold tops of bottles during bottle closing; said closing station rotatable holding apparatus comprising: a first set of openings configured to hold and position bottle tops having a first size to be closed under their corresponding closing devices; and a second set of openings configured to hold and position bottle tops having a second size to be closed under their corresponding closing devices; and a set of cleaning devices configured to be disposed under and to clean at least their corresponding closing apparatus; said closing station rotatable holding apparatus being configured to rotate with respect to said closing devices to electively position one of: said first set of openings; said second set of openings; and said cleaning devices; under their corresponding closing devices; a closing station rotation arrangement configured to rotate and position said closing station rotatable holding apparatus with respect to said closing devices; said beverage bottling plant further comprising: a third conveyor arrangement being configured and disposed to move bottles from said rotatable bottle closing station.

Another feature or aspect of an embodiment is believed at the time of the filing of this patent application to possibly reside broadly in a beverage bottling plant for filling bottles, wherein said rotatable holding apparatus comprises an interchangeable part; said interchangeable part including said first set of openings and said second set of openings for said rotatable holding apparatus to permit changing said first set of openings and said second set of openings to different sets of openings for said rotatable holding apparatus.

Yet another feature or aspect of an embodiment is believed at the time of the filing of this patent application to possibly reside broadly in A plant for filling containers with a filling material, said plant comprising: a filling machine being configured and disposed to fill empty containers with filling material; said filling machine comprising a rotatable structure; said rotatable filling machine also comprising a plurality of filling stations, each filling station comprising a filling device for filling containers; a first conveyor arrangement being configured and disposed to move empty containers into said rotatable filling machine; said plant for filling containers further comprising: a first star wheel arrangement configured to move containers from said first conveyor arrangement to said filling machine rotatable structure; and a rotatable holding apparatus configured to hold tops of containers at least during filling in said rotatable filling machine; an arrangement configured to rotate and position said rotatable holding apparatus with respect to said filling devices; a rotatable closing station being configured and disposed to close containers; a second conveyor arrangement being configured and disposed to move empty containers into said rotatable closing station; said rotatable closing station comprising closing devices to close containers; said closing station comprising a rotatable structure; said plant for filling containers further comprising: a second star wheel arrangement configured to move containers from said second conveyor arrangement to said rotatable closing station; and a rotatable holding apparatus configured to hold tops of containers during container closing; said rotatable holding apparatus or said rotatable holding apparatus configured to hold tops of containers during container closing comprising: at least a first set of openings configured to hold and position container tops having at least a first size under their corresponding filling or closing devices; and a set of cleaning devices configured to be disposed to clean at least their corresponding filling or closing devices; said rotatable holding apparatus or rotatable holding apparatus configured to hold tops of containers during container closing being configured to rotate with respect to their corresponding filling or closing devices to electively position one of: said first set of openings; and said cleaning devices; under their corresponding filling or closing devices.

Still another feature or aspect of an embodiment is believed at the time of the filing of this patent application to possibly reside broadly in A plant for filling containers with a filling material, said plant comprising: a filling machine being configured and disposed to fill empty containers with filling material; said filling machine comprising a rotatable structure; said rotatable filling machine also comprising a plurality of filling stations, each filling station comprising a filling device for filling containers; a rotatable closing station being configured and disposed to close containers; said rotatable closing station comprising closing devices to close containers; said closing station comprising a rotatable structure; at least one of said filling machine rotatable structure or said rotatable closing station comprising: a first conveyor arrangement being configured and disposed to move empty containers into said rotatable filling machine; a rotatable holding apparatus configured to hold tops of containers at least during filling or closing; said plant for filling containers further comprising: a star wheel configured to move containers from said first conveyor arrangement to its corresponding rotatable filling machine or rotatable closing station; an arrangement configured to rotate and position said rotatable holding apparatus with respect to its filling or closing devices; said rotatable holding apparatus or said rotatable holding apparatus configured to hold tops of containers during container filling or closing comprising: at least a first set of openings configured to be rotated and hold and position container tops, having at least a first size, under their corresponding filling or closing devices; and a set of cleaning devices configured to be rotated under to clean at least their corresponding filling or closing devices; said rotatable filling machine holding apparatus or rotatable closing station holding apparatus, configured to hold tops of containers during container filling or closing, being configured to rotate with respect to their corresponding filling or closing devices to electively position one of: said at least one first set of openings; and said cleaning devices; under their corresponding filling or closing devices.

A further feature or aspect of an embodiment is believed at the time of the filing of this patent application to possibly reside broadly in a plant for filling containers with a filling material, said plant comprising: a filling machine being configured and disposed to fill empty containers with filling material; said filling machine comprising a rotatable structure; said rotatable filling machine also comprising a plurality of filling stations, each filling station comprising a filling device for filling containers; a rotatable closing station being configured and disposed to close containers; said rotatable closing station comprising closing devices to close containers; said closing station comprising a rotatable structure; at least one of said filling machine rotatable structure or said rotatable closing station comprising: a rotatable holding apparatus configured to hold tops of containers at least during filling or closing; an arrangement configured to rotate and position said rotatable holding apparatus with respect to its corresponding filling or closing devices; a first conveyor arrangement being configured and disposed to move empty containers into said rotatable filling machine; said rotatable holding apparatus or said rotatable holding apparatus configured to hold tops of containers during container filling or closing comprising: at least a first set of openings configured to be rotated and hold and position container tops, having at least a first size, under their corresponding filling or closing devices; and a set of cleaning devices configured to be rotated under and to clean at least their corresponding filling or closing devices; said rotatable filling machine holding apparatus or rotatable closing station holding apparatus, configured to hold tops of containers during container filling or closing, being configured to rotate with respect to its corresponding filling or closing devices to electively position one of: said at least one first set of openings; and said cleaning devices; under their corresponding filling or closing devices.

Another feature or aspect of an embodiment is believed at the time of the filing of this patent application to possibly reside broadly in an apparatus for exchanging operating units disposed at rotating container handling machines, particularly upper handling components for varying the filling program, the cleaning program and/or the closing program, wherein units are removed and replacement units are mounted in place of the removed units, characterized in that each upper operating head (for example filling element) (4) is associated with a plurality of replacement units (18, 19, 20) and these replacement units can be attached during a replacement at all operating heads (4) at the same time and/or exchanged at the same time and/or can be brought with these (4) into the operative position.

Another feature or aspect of an embodiment is believed at the time of the filing of this patent application to possibly reside broadly in an apparatus with operating heads, such as, filling elements and the like that are disposed at a rotating carrier, characterized in that in the region of the operating heads (4) there is arranged a receiving apparatus (21) that is associated with the operating heads (4), which receiving apparatus comprises a plurality of replacement components (18-20) and these individual receiving apparatus (21) are disposed to be—together with the received replacement components (18-20) in relationship with the position of the operating heads (4)—are configured and disposed to be adjusted and/or to be rotated.

Yet another feature or aspect of an embodiment is believed at the time of the filing of this patent application to possibly reside broadly in an apparatus, characterized in that beneath the filling elements (operating heads) (4) there is disposed a ring structure (21) that is configured to rotate and to be varied, at which ring structure (21) are arranged the corresponding replacement components (18-20) of a filling element and these (18-20?) can be rotated together with the ring structure (21) about the axis of rotation (MA) of the handling machine and they are configured and disposed to be brought into the operative position.

Still another feature or aspect of an embodiment is believed at the time of the filing of this patent application to possibly reside broadly in an apparatus, characterized in that the replacement components (18-20) are configured as differing bottle neck receiving device, centering device and/or bottle centering device and/or rinsing container/rinsing nozzle.

A further feature or aspect of an embodiment is believed at the time of the filing of this patent application to possibly reside broadly in an apparatus, characterized in that the replacement components (18-20), on the one hand, are disposed as receiving devices, centering devices and support devices for bottle tops and/or container tops (4) and, on the other hand, as cleaning conduits and/or flushing or rinsing conduits (20) for the filling elements and are disposed in position in the region of the filling elements.

Another feature or aspect of an embodiment is believed at the time of the filing of this patent application to possibly reside broadly in an apparatus, characterized in that the adjustment ring (21) is configured in the shape of a CIP-annular channel and/or media-channel, and/or takes up such a channel, and/or is connected with this (21).

Yet another feature or aspect of an embodiment is believed at the time of the filing of this patent application to possibly reside broadly in an apparatus, characterized in that the spray nozzles (20) also form inlet channels and outlet channels for further media or sterilizing media, or comprise such channels. A plant for filling containers with a filling material, said plant comprising:

A further feature or aspect of an embodiment is believed at the time of the filing of this patent application to possibly reside broadly in a plant for filling containers with a filling material, said plant comprising: a filling machine being configured and disposed to fill empty containers with filling material; said filling machine comprising a rotatable structure; said rotatable filling machine also comprising a plurality of filling stations, each filling station comprising a filling device for filling containers; a rotatable closing station being configured and disposed to close containers; said rotatable closing station comprising closing devices to close containers; said closing station comprising a rotatable structure; at least one of said filling machine rotatable structure or said rotatable closing station comprising: a rotatable holding apparatus configured to hold tops of containers at least during filling or closing; an arrangement configured to rotate and position said rotatable holding apparatus with respect to its corresponding filling or closing devices; a first conveyor arrangement being configured and disposed to move empty containers into said rotatable filling machine; said rotatable holding apparatus or said rotatable holding apparatus configured to hold tops of containers during container filling or closing comprising: at least a first set of openings configured to be rotated and hold and position container tops, having at least a first size, under their corresponding filling or closing devices; and a set of cleaning devices configured to be rotated under and to clean at least their corresponding filling or closing devices; said rotatable filling machine holding apparatus or rotatable closing station holding apparatus, configured to hold tops of containers during container filling or closing, being configured to rotate with respect to its corresponding filling or closing devices to electively position one of: said at least one first set of openings; and said cleaning devices; adjacent their corresponding filling or closing devices.

Still another feature or aspect of an embodiment is believed at the time of the filing of this patent application to possibly reside broadly in a plant for filling containers with a filling material, said plant comprising: a filling machine being configured and disposed to fill empty containers with filling material: said filling machine comprising a rotatable structure; said rotatable filling machine also comprising a plurality of filling stations, each filling station comprising a filling device for filling containers; a rotatable closing station being configured and disposed to close containers; said rotatable closing station comprising closing devices to close containers; said closing station comprising a rotatable structure; at least one of said filling machine rotatable structure or said rotatable closing station comprising: a rotatable holding apparatus configured to hold tops of containers at least during filling or closing; an arrangement configured to rotate and position said rotatable holding apparatus with respect to its corresponding filling or closing devices; a first conveyor arrangement being configured and disposed to move empty containers into said rotatable filling machine; said rotatable holding apparatus or said rotatable holding apparatus configured to hold tops of containers during container filling or closing comprising: at least a first set of openings configured to be rotated and hold and position container tops, having at least a first size, under their corresponding filling or closing devices; and a set of cleaning devices configured to be rotated under and to clean at least their corresponding filling or closing devices; said rotatable filling machine holding apparatus or rotatable closing station holding apparatus, configured to hold tops of containers during container filling or closing, being configured to rotate with respect to its corresponding filling or closing devices to electively position one of: said at least one first set of openings; and said cleaning devices; immediately adjacent their corresponding filling or closing devices.

In the event that automatic tool changes would be desirable in a possible embodiment, some examples of automatic tool changer apparatuses which may possibly be utilized or adapted for use in at least one possible embodiment may possibly be found in the following U.S. Pat. No. 5,300,006, entitled "Automatic tool changer;" U.S. Pat. No. 4,835,838, entitled "Automatic tool changer in machine tool;" U.S. Pat. No. 4,799,308, entitled "Automatic tool changer;" U.S. Pat. No. 4,773,152, entitled "Automatic tool changer;" U.S. Pat. No. 4,764,064, entitled "Tool changer;" U.S. Pat. No. 4,696,091, entitled "Automatic tool changer;" U.S. Pat. No. 4,614,137, entitled "Magnetic tool changer;" U.S. Pat. No. 4,610,074, entitled "Automatic tool changer of a machine tool;" U.S. Pat. No. 4,601,094, entitled "Turning machine with an automatic tool changer;" U.S. Pat. No. 4,499,650, entitled "Automatic tool changer;" U.S. Pat. No. 4,467,517, entitled "Tool changer for facing head;" U.S. Pat. No. 4,387,502, entitled "Semi-automatic tool changer;" and U.S. Pat. No. 4,329,770, entitled "Automatic tool changer."

An example of a beverage container closing machine which may possibly be utilized or adapted for use in at least one possible embodiment may be found in Federal Republic of Germany Application No. P 103 26 618.6, filed on Jun. 13, 2003, having inventor Volker TILL, and its U.S. equivalent, Ser. No. 10/865,240, filed on Jun. 10, 2004. Both applications are hereby incorporated by reference as if set forth in their entirety herein.

The components disclosed in the various publications, disclosed or incorporated by reference herein, may possibly be used in possible embodiments of the present invention, as well as equivalents thereof.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004. The above applications are hereby incorporated by reference as if set forth in their entirety herein.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; U.S. Pat. No. 4,944,830; U.S. Pat. No. 4,950,350; U.S. Pat. No. 4,976,803; U.S. Pat. No. 4,981,547; U.S. Pat. No. 5,004,518; U.S. Pat. No. 5,017,261; U.S. Pat. No. 5,062,917; U.S. Pat. No. 5,062,918; U.S. Pat. No. 5,075,123; U.S. Pat. No. 5,078,826; U.S. Pat. No. 5,087,317; U.S. Pat. No. 5,110,402; U.S. Pat. No. 5,129,984; U.S. Pat. No. 5,167,755; U.S. Pat. No. 5,174,851; U.S. Pat. No. 5,185,053; U.S. Pat. No. 5,217,538; U.S. Pat. No. 5,227,005; U.S. Pat. No. 5,413,153; U.S. Pat. No. 5,558,138; U.S. Pat. No. 5,634,500; U.S. Pat. No. 5,713,403; U.S. Pat. No. 6,276,113; U.S. Pat. No. 6,213,169; U.S. Pat. No. 6,189,578; U.S. Pat. No. 6,192,946; U.S. Pat. No. 6,374,575; U.S. Pat. No. 6,365,054; U.S. Pat. No. 6,619,016; U.S. Pat. No. 6,474,368; U.S. Pat. No. 6,494,238; U.S. Pat. No. 6,470,922; and U.S. Pat. No. 6,463,964.

The appended drawings in their entirety, including all dimensions, proportions and/or shapes in at least one embodiment, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of sensors that may possibly be utilized or possibly adapted for use in at least one possible embodiment of the present application may possibly be found in the following U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The sentence immediately above relates to patents, published patent applications and other documents either incorporated by reference or not incorporated by reference.

Some examples of bottling systems which may possibly be utilized or adapted for use in at least one possible embodiment may possibly be found in the following U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

The corresponding foreign patent publication applications, namely, Federal Republic of Germany Patent Application No. 103 40 365.5, filed on Sep. 2, 2003, having inventor Dieter-Rudolf KRULITSCH, and DE-OS 103 40 365.5 and DE-PS 103 40 365.5, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

Given the increased requirements relating to the quality of the beverages to be bottled and their shelf life, a construction is necessary in which the handling spaces are in an enclosed space that can be filled with a controlled atmosphere. This space can be filled with an inert gas atmosphere, e.g. $CO_2$ with a sterilizing atmosphere of $H_2O_2$ for example, to thereby ensure a low-oxygen and aseptic processing of the beverages, which is of priority importance for the quality of the beverages being bottled, in particular when the cold bottling method which is preferred by many users is employed. A variety of such handling machines are used in the beverage industry.

DE-PS 696 569 describes a construction of this type in which a filling machine is located in a closed housing. The space thereby formed is determined by the overall size of the machine and encloses a considerable volume. DE 199 11 517 A1 describes a rotating filling machine which is located in its entirety inside a housing that encloses it with very little clearance on all sides. The size of the housing is determined by the size of the machine and is thereby likewise of considerable volume. DE 198 35 369 C1 shows a realization in which the container handling machines extend in a sealed manner with their handling spaces located on the bottom downward into a space in which there is a controlled atmosphere. This space is designed so that it is accessible from underneath the machine. DE-PS 696 569 DE 199 11 517 A1, and DE 198 35 369 C1 are hereby incorporated by reference as if set forth in their entirety herein.

An additional solution is disclosed in DE 197 31 796. In this industrial configuration, the filling and capping machines are located in a clean room, the volume of which is so small that there is only free space to perform the necessary service and maintenance work on the filling and capping machine. The purpose of reducing the volume of the clean space is to reduce the operating costs of the plant. An immersion sterilizer is also located directly adjacent to the clean space. The purpose of this measure, in comparison to EP 0120 789, is to eliminate the second rinser and the associated acquisition and operating costs. Overall, one disadvantage of this solution is that here, too, a clean space is provided that encloses both the filling and capping machine in their entirety, which means that the clean space will be very large and will entail high construction and operating costs. The greatest possible reduction in the volume of the clean space, which is the object of this realization of the prior art, also has major disadvantages in terms of restricting access for any maintenance work that has to be performed. DE 197 31 796 and EP 0120 789 are hereby incorporated by reference as if set forth in their entirety herein.

Federal Republic of Germany Application No. DE P 103 42 415.6, entitled "Vessel treatment machine," having inventor and its U.S. equivalent, Ser. No. 10/939,170, describe a container handling machine enclosed within an aseptic clean room. Federal Republic of Germany Application No. DE P 103 42 415.6, entitled "Vessel treatment machine," and its U.S. equivalent, Ser. No. 10/939,170, are hereby incorporated by reference as if set forth in their entirety herein.

In one possible embodiment, the container handling machine could be enclosed in a closed chamber in a special aseptic room, such as in the aseptic systems found in U.S. Patent Publication No. 20040112460, entitled "Filling machine," and No. 20020083682, entitled "Aseptic bottle filling system," and in U.S. Pat. No. 5,860,461, entitled "Container, a container sealing cap, a process and a machine for cold-aseptic filling with beverages," and U.S. Pat. No. 6,326,032, entitled "Beverage manufacture and cold aseptic bottling using peroxyacid antimicrobial composition."

In one possible embodiment, a first conveyor arrangement may move empty bottles from a bottle preparing station and into a rotatable beverage filling machine. The beverage filling machine may comprise a rotatable structure. The rotatable beverage filling machine may further comprise a plurality of beverage filling stations. Each beverage filling station may comprise a beverage filling device for filling bottles with liquid beverage filling material.

The filling devices may comprise an apparatus being configured to introduce a predetermined volume of liquid beverage filling material into the interiors of the bottles to a substantially predetermined level of liquid beverage filling material. The filling devices may further be configured to terminate the filling of beverage bottles upon the liquid beverage filling material reaching the substantially predetermined level in the bottles.

The beverage bottling system may comprise a star wheel, which star wheel could be configured to move bottles through said rotatable beverage filling machine. The filling machine rotatable structure may further comprise a rotatable holding apparatus configured to hold the tops of the bottles, at least during filling, in the rotatable beverage filling machine. The filling machine rotatable holding apparatus may comprise a first set of openings configured to hold and position bottle tops having a first size under their corresponding filling devices. The filling machine rotatable holding apparatus may further comprise a second set of openings, which second set of openings could be a different size than the first set of openings. The second set of openings could be configured to hold and position bottle tops having a second size, such as three-liter plastic bottles, under their corresponding filling devices. In other words, the filling machine rotatable holding apparatus may comprise at least two sets of openings, each set of openings having a different size for holding at least two different size bottles, such as two-liter and three-liter bottles. The two sets of openings are configured to hold the bottles beneath their corresponding filling devices to be filled.

The filling machine rotatable structure may further comprise a set of cleaning devices configured to be disposed under and to clean at least their corresponding filling devices. A flushing or rinsing nozzle could be configured and disposed to be connected by way of a flexible conduit to the supply centers. Special seal arrangements at the flushing or rinsing conduit and/or the lower portion of a filling element may ensure a positive sealing of the adjacent components. As illustrated in FIG. 4, the flushing or rinsing nozzle could be configured and disposed to be associated with a filling element such that the flushing or rinsing nozzle may spray up into the filling element and effectively flush the filling element. The flushing or rinsing nozzle may also be configured and disposed such that it is not disposed directly beneath a filling element, but is still able to spray in order to clean the top surface or other surfaces of the filling machine rotatable structure or any components thereof. In this position, the flushing or rinsing nozzle may also spray upwards and clean the bottom surface of the rotor.

The filling machine rotatable holding apparatus may be configured to rotate with respect to the filling devices to electively position one of the first set of openings, the second set of openings, and the cleaning devices or flushing or rinsing nozzles, under their corresponding filling devices. The filling machine rotatable holding apparatus may be configured to rotate by way of a filling machine rotation arrangement, which filling machine rotation arrangement could be configured to rotate and position the rotatable holding apparatus with respect to the filling devices.

A second conveyor arrangement may be configured and disposed to move filled bottles from said rotatable beverage filling machine and to a rotatable closing station. The rotatable closing station may comprise a first star wheel configured to move bottles from the filling machine and to the closing station. The rotatable closing station may be configured and disposed to secure bottle closures to bottles and may comprise closing devices to close bottles. The bottle closing station may further comprise a rotatable structure. The closing station rotatable structure may comprise a rotatable holding apparatus configured to hold tops of bottles during bottle closing.

The closing station rotatable holding apparatus may comprise a first set of openings configured to hold and position bottle tops having a first size, e.g., a two-liter plastic bottle, to be closed under their corresponding closing devices. The closing station rotatable holding apparatus may further comprise a second set of openings configured to hold and position bottle tops having a second size to be closed under their corresponding closing devices. In other words, the closing station rotatable holding apparatus may comprise at least two sets of openings, each set of openings having a different size for holding at least two different size bottles. The two sets of openings are configured to hold the bottles beneath their corresponding closing devices to be closed.

The closing station rotatable holding apparatus may further comprise a set of cleaning devices or flushing or rinsing nozzles configured to be disposed under and to clean at least their corresponding closing apparatus. A flushing or rinsing nozzle could be configured and disposed to be connected by way of a flexible conduit to the supply centers. Special seal arrangements at the flushing or rinsing conduit and/or the lower portion of a closing device may ensure a positive sealing of the adjacent components. The flushing or rinsing nozzle could be configured and disposed to be connected to a closing device such that the flushing or rinsing nozzle may spray up into the closing device and effectively flush the closing device. The flushing or rinsing nozzle may also be configured and disposed such that it is not disposed directly beneath a closing device, but is still able to spray in order to clean the top surface or other surfaces of the closing machine rotatable structure or any components thereof. In this position, the flushing or rinsing nozzle may also spray upwards and clean the bottom surface of the rotor.

The closing station rotatable holding apparatus may be configured to rotate with respect to the closing devices to electively position one of the first set of openings, the second set of openings, and the cleaning devices or flushing or rinsing nozzles under their corresponding closing devices. The closing station rotatable holding apparatus may be configured to rotate by way of a closing station rotation arrangement, which closing station rotation arrangement may be configured to rotate and position the closing station rotatable holding apparatus with respect to the closing devices.

The beverage bottling plant may further comprise a third conveyor arrangement, which conveyer arrangement may be configured and disposed to move bottles from said rotatable bottle closing station once the bottles have been closed.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

AT LEAST PARTIAL LIST OR REFERENCE NUMBERS

1 Filling machine, filler
2 Bottles
3 Rotor
4 Filing element
5 Dividing screw
6 Input star conveyer, star wheel conveyer
7 Transfer star conveyer, star wheel conveyer
8 Closer, closing station, closing machine
9 Exit star wheel conveyer, star wheel conveyer
10 Transport conveyer for filled, closed bottles
11 Guide element for 6
12 Guide element for 7
13 Guide element for 9
14 Annular vessel
15 Housing
16 Channel for liquid in 15
17 Exit opening, filling opening, lower portion
18 Large neck support
19 Neck
20 Flushing conduit, flushing nozzle
21 Ring structure
24 Sterile compartment
25 Stationary ring structure
100 Beverage bottling plant
101 Rinser, rinser station—change to 3
103 Conveyer to feed bottles to rinser
104 Conveyer to pass bottles to filling machine
104*a* Star wheel
105 Beverage filling machine
105' Rotor
106 Closer, closer station
107 Conveyer to pass containers to labeling station
108 Labeling station, labeling device
108*a* Labeling module for first product
108*b* Labeling module for second product
108*c* Inspecting station or module
109 Conveyer to output first product containers
110 Conveyer arrangement to output second product containers
111 Conveyer arrangement to output incorrectly labeled containers
112 Central control unit, controller
113 Filling positions
113*a* Container carriers/bottle carriers
114 Filling device, element, apparatus
117 Toroidal vessel
121 Conduit for first product
122 Conduit for second product
123 First product mixer
124 Second product mixer
A Direction of travel of bottles
B Bottles

What is claimed is:

1. A beverage bottling plant for filling bottles with a liquid beverage filling material, said beverage bottling plant comprising:

a bottle preparing station being configured and disposed to prepare bottles for filling with a liquid beverage;

a rotary beverage filling machine being configured and disposed to fill empty bottles with liquid beverage filling material;

a first conveyor arrangement being configured and disposed to move empty bottles from said bottle preparing station into said rotary beverage filling machine;

a storage apparatus being configured and disposed to store a liquid beverage filling material;

a conduit arrangement being configured and disposed to supply liquid beverage filling material from said storage apparatus to said rotary beverage filling machine;

said rotary beverage filling machine comprising:

a rotor being configured and disposed to rotate about a central, vertical axis of rotation;

a plurality of beverage filling devices for filling bottles with liquid beverage filling material being disposed on and around the periphery of said rotor;

said filling devices being configured to introduce a volume of liquid beverage filling material into interiors of bottles to a substantially predetermined level of liquid beverage filling material and to terminate the filling of beverage bottles upon liquid beverage filling material reaching said substantially predetermined level in bottles;

a rotatable, ring-shaped holding apparatus being configured to hold tops of bottles and position each bottle under a corresponding one of said filling devices at least during filling in said rotary beverage filling machine;

said filling machine rotatable holding apparatus being connected to and configured to rotate with said rotor, and having a substantially similar diameter as said rotor;

a holding apparatus rotation arrangement being configured to rotate and position said rotatable holding apparatus with respect to said filling devices;

said filling machine rotatable holding apparatus comprising:

a first set of openings being configured to hold and position bottle tops having a first size;

said first set of openings being disposed at intervals from one another around the periphery of said filling machine rotatable holding apparatus;

a second set of openings being configured to hold and position bottle tops having a second size, said second size being different from said first size;

said second set of openings being disposed at intervals from one another around the periphery of said filling machine rotatable holding apparatus, wherein each of said second set of openings is disposed next to a corresponding one of said first set of openings;

a set of cleaning devices being configured to be disposed under said filling devices and to clean at least said filling devices; and said set of cleaning devices being disposed at intervals from one another around the periphery of said filling machine rotatable holding apparatus, wherein each of said set of cleaning devices is disposed between and next to a corresponding one of said first set of openings and a corresponding one of said second set of openings;

said filling machine rotatable holding apparatus being configured to be rotated to position each of said first set of openings under its corresponding filling device to permit said filling machine to receive, hold, and fill bottles having bottle tops having said first size;

said filling machine rotatable holding apparatus being configured to be rotated to position each of said second set of openings under its corresponding filling device to permit said filling machine to receive, hold, and fill bottles having bottle tops having said second size;

said filling machine rotatable holding apparatus being configured to be rotated to position each of said cleaning devices under its corresponding filling device to permit said cleaning devices to clean at least said filling devices; and said holding apparatus rotation arrangement being configured to rotate and position said filling machine rotatable holding apparatus to electively position: each of said first set of openings under its corresponding filling device, each of said second set of openings under its corresponding filling device, and each of said cleaning devices under its corresponding filling device;

a rotatable closing station being configured and disposed to secure bottle closures to bottles;

a second conveyor arrangement being configured and disposed to move filled bottles from said rotary beverage filling machine into said rotatable closing station;

said rotary beverage closing machine comprising:

a rotor being configured and disposed to rotate about a central, vertical axis of rotation;

a plurality of closing devices for closing filled bottles being disposed on and around the periphery of said rotor;

a rotatable, ring-shaped holding apparatus being configured to hold tops of bottles and position each bottle under a corresponding one of said closing devices at least during closing of the bottles in said closing machine;

said closing machine rotatable holding apparatus being connected to and configured to rotate with said rotor, and having a substantially similar diameter as said rotor;

a holding apparatus rotation arrangement being configured to rotate and position said rotatable holding apparatus with respect to said closing devices;

said closing machine rotatable holding apparatus comprising:

a first set of openings being configured to hold and position bottle tops having a first size;

said first set of openings being disposed at intervals from one another around the periphery of said closing machine rotatable holding apparatus;

a second set of openings being configured to hold and position bottle tops having a second size, said second size being different from said first size;

said second set of openings being disposed at intervals from one another around the periphery of said closing machine rotatable holding apparatus, wherein each of said second set of openings is disposed next to a corresponding one of said first set of openings;

a set of cleaning devices being configured to be disposed under said closing devices and to clean at least said closing devices; and said set of cleaning devices being disposed at intervals from one another around the periphery of said closing machine rotatable holding apparatus, wherein each of said set of cleaning devices is disposed between and next to a corresponding one of said first set of openings and a corresponding one of said second set of openings;

said closing machine rotatable holding apparatus being configured to be rotated to position each of said first set of openings under its corresponding closing device to permit said closing machine to receive, hold, and close bottles having bottle tops having said first size;

said closing machine rotatable holding apparatus being configured to be rotated to position each of said second set of openings under its corresponding closing device to permit said closing machine to receive, hold, and close bottles having bottle tops having said second size;

said closing machine rotatable holding apparatus being configured to be rotated to position each of said cleaning devices under its corresponding closing device to permit said cleaning devices to clean at least said closing devices; and said holding apparatus rotation arrangement being configured to rotate and position said closing machine rotatable holding apparatus to electively position: each of said first set of openings under its corresponding closing device, each of said second set of openings under its corresponding closing device, and each of said cleaning devices under its corresponding closing device; and a third conveyor arrangement being configured and disposed to move bottles from said rotatable bottle closing station.

2. The beverage bottling plant according to claim 1, wherein:

said filling machine rotatable holding apparatus is configured in the shape of a CIP-annular channel and/or media-channel, and/or takes up such a channel; and each of said set of cleaning devices of said filling machine comprises spray nozzles that also form inlet channels and outlet channels for further media or sterilizing media.

3. A container filling plant for filling containers with a filling material, said container filling plant comprising:

a rotary filling machine being configured and disposed to fill empty containers with a filling material;

a first conveyor arrangement being configured and disposed to move empty containers into said filling machine;

said filling machine comprising:

a rotor being configured and disposed to rotate about a central axis;

a plurality of filling devices for filling containers being disposed on and around the periphery of said rotor;

a rotatable, ring-shaped holding apparatus being configured to hold tops of containers and position each container under a corresponding one of said filling devices at least during filling in said filling machine;

said filling machine rotatable holding apparatus being connected to and configured to rotate with said rotor;

a holding apparatus rotation arrangement being configured to rotate and position said rotatable holding apparatus with respect to said filling devices;

said filling machine rotatable holding apparatus comprising:

a first set of openings being configured to hold and position container tops having a first size;

said first set of openings being disposed at intervals from one another around the periphery of said filling machine rotatable holding apparatus;

a second set of openings being configured to hold and position container tops having a second size, said second size being different from said first size;

said second set of openings being disposed at intervals from one another around the periphery of said filling machine rotatable holding apparatus, wherein each of said second set of openings is disposed next to a corresponding one of said first set of openings;

a set of cleaning devices being configured to be disposed under said filling devices and to clean at least said filling devices; and said set of cleaning devices being disposed at intervals from one another around the periphery of said filling machine rotatable holding apparatus, wherein each of said set of cleaning devices is disposed between and next to a corresponding one of said first set of openings and a corresponding one of said second set of openings;

said filling machine rotatable holding apparatus being configured to be rotated to position each of said first set of openings under its corresponding filling device to permit said filling machine to receive, hold, and fill containers having container tops having said first size;

said filling machine rotatable holding apparatus being configured to be rotated to position each of said second set of openings under its corresponding filling device to permit said filling machine to receive, hold, and fill containers having container tops having said second size;

said filling machine rotatable holding apparatus being configured to be rotated to position each of said cleaning devices under its corresponding filling device to permit said cleaning devices to clean at least said filling devices; and said holding apparatus rotation arrangement being configured to rotate and position said filling machine rotatable holding apparatus to electively position: each of said first set of openings under its corresponding filling device, each of said second set of openings under its corresponding filling device, and each of said cleaning devices under its corresponding filling device;

a rotary closing machine being configured and disposed to secure container closures to containers;

a second conveyor arrangement being configured and disposed to move filled containers from said filling machine into said closing machine;

said closing machine comprising:

a rotor being configured and disposed to rotate about a central axis;

a plurality of closing devices for closing filled containers being disposed on and around the periphery of said rotor;

a rotatable, ring-shaped holding apparatus being configured to hold tops of containers and position each container under a corresponding one of said closing devices at least during closing of the containers in said closing machine;

said closing machine rotatable holding apparatus being connected to and configured to rotate with said rotor;

a holding apparatus rotation arrangement being configured to rotate and position said rotatable holding apparatus with respect to said closing devices;

said closing machine rotatable holding apparatus comprising:

a first set of openings being configured to hold and position container tops having a first size;

said first set of openings being disposed at intervals from one another around the periphery of said closing machine rotatable holding apparatus;

a second set of openings being configured to hold and position container tops having a second size, said second size being different from said first size;

said second set of openings being disposed at intervals from one another around the periphery of said closing machine rotatable holding apparatus, wherein each of said second set of openings is disposed next to a corresponding one of said first set of openings;

a set of cleaning devices being configured to be disposed under said closing devices and to clean at least said closing devices; and said set of cleaning devices being disposed at intervals from one another around the periphery of said closing machine rotatable holding apparatus, wherein each of said set of cleaning devices is disposed between and next to a corresponding one of said first set of openings and a corresponding one of said second set of openings;

said closing machine rotatable holding apparatus being configured to be rotated to position each of said first set of openings under its corresponding closing device to permit said closing machine to receive, hold, and close containers having container tops having said first size;

said closing machine rotatable holding apparatus being configured to be rotated to position each of said second set of openings under its corresponding closing device to permit said closing machine to receive, hold, and close containers having container tops having said second size;

said closing machine rotatable holding apparatus being configured to be rotated to position each of said cleaning devices under its corresponding closing device to permit said cleaning devices to clean at least said closing devices; and said holding apparatus rotation arrangement being configured to rotate and position said closing machine rotatable holding apparatus to electively position: each of said first set of openings under its corresponding closing device, each of said second set of openings under its corresponding closing device, and each of said cleaning devices under its corresponding closing device; and a third conveyor arrangement being configured and disposed to move containers from said container closing machine.

4. The container filling plant according to claim 3, wherein said filling machine rotatable holding apparatus is configured in the shape of a CIP-annular channel and/or media-channel, and/or takes up such a channel.

5. The container filling plant according to claim 4, wherein each of said set of cleaning devices of said filling machine comprises are spray nozzles that also form inlet channels and outlet channels for further media or sterilizing media.

6. A container filling plant for filling containers with a filling material, said container filling plant comprising:

a filling machine being configured and disposed to fill empty containers with a filling material;

a first conveyor arrangement being configured and disposed to move empty containers into said filling machine;

a rotatable closing machine being configured and disposed to secure container closures to containers;

a second conveyor arrangement being configured and disposed to move filled containers from said filling machine into said closing machine;

a third conveyor arrangement being configured and disposed to move containers from said container closing machine; and at least one of (A) and (B):

(A) said filling machine comprising:

a rotor being configured and disposed to rotate about a central axis;

a plurality of filling devices for filling containers being disposed on and around the periphery of said rotor;

a rotatable, ring-shaped holding apparatus being configured to hold containers and position each container under a corresponding one of said filling devices at least during filling in said filling machine;

said filling machine rotatable holding apparatus being connected to and configured to rotate about the central axis of said rotor and with said rotor;

a holding apparatus rotation arrangement being configured to rotate and position said rotatable holding apparatus with respect to said filling devices;

said filling machine rotatable holding apparatus comprising:

openings being configured to hold and position containers;

said openings being disposed at intervals from one another around the periphery of said filling machine rotatable holding apparatus;

cleaning devices being configured to be disposed under said filling devices and to clean at least said filling devices; and said cleaning devices being disposed at intervals from one another around the periphery of said filling machine rotatable holding apparatus, wherein each of said set of cleaning devices is disposed between a corresponding pair of said openings;

said filling machine rotatable holding apparatus being configured to be rotated to position each of said openings under its corresponding filling device to permit said filling machine to receive, hold, and fill containers;

said filling machine rotatable holding apparatus being configured to be rotated to position each of said cleaning devices under its corresponding filling device to permit said cleaning devices to clean at least said filling devices; and said holding apparatus rotation arrangement being configured to rotate relative to said rotor and position said filling machine rotatable holding apparatus to electively position: each of said first set of openings under its corresponding filling device, and each of said cleaning devices under its corresponding filling device; and (B) said closing machine comprising:

a rotor being configured and disposed to rotate about a central axis;

a plurality of closing devices for closing filled containers being disposed on and around the periphery of said rotor;

a rotatable, ring-shaped holding apparatus being configured to hold containers and position each container under a corresponding one of said closing devices at least during closing of the containers in said closing machine;

said closing machine rotatable holding apparatus being connected to and configured to rotate about the central axis of said rotor and with said rotor;

a holding apparatus rotation arrangement being configured to rotate and position said rotatable holding apparatus with respect to said closing devices;

said closing machine rotatable holding apparatus comprising:

openings being configured to hold and position containers;

said openings being disposed at intervals from one another around the periphery of said closing machine rotatable holding apparatus;

cleaning devices being configured to be disposed under said closing devices and to clean at least said closing devices; and said cleaning devices being disposed at intervals from one another around the periphery of said closing machine rotatable holding apparatus, wherein each of said set of cleaning devices is disposed between a corresponding pair of said openings;

said closing machine rotatable holding apparatus being configured to be rotated to position each of said openings under its corresponding closing device to permit said closing machine to receive, hold, and close containers;

said closing machine rotatable holding apparatus being configured to be rotated to position each of said cleaning devices under its corresponding closing device to permit said cleaning devices to clean at least said closing devices; and said holding apparatus rotation arrangement being configured to rotate relative to said rotor and position said closing machine rotatable holding apparatus to electively position: each of said first set of openings under its corresponding closing device, and each of said cleaning devices under its corresponding closing device.

7. The container filling plant according to claim 6, wherein said filling machine rotatable holding apparatus is configured in the shape of a CIP-annular channel and/or media-channel, and/or takes up such a channel.

8. The container filling plant according to claim 7, wherein each of said set of cleaning devices of said filling machine comprises spray nozzles that also form inlet channels and outlet channels for further media or sterilizing media.

9. The container filling plant according to claim 6, wherein said filling machine comprises:

a rotor being configured and disposed to rotate about a central axis;

a plurality of filling devices for filling containers being disposed on and around the periphery of said rotor;

a rotatable, ring-shaped holding apparatus being configured to hold containers and position each container under a corresponding one of said filling devices at least during filling in said filling machine;

said filling machine rotatable holding apparatus being connected to and configured to rotate about the central axis of said rotor and with said rotor;

a holding apparatus rotation arrangement being configured to rotate and position said rotatable holding apparatus with respect to said filling devices;

said filling machine rotatable holding apparatus comprising:

openings being configured to hold and position containers;

said openings being disposed at intervals from one another around the periphery of said filling machine rotatable holding apparatus;

cleaning devices being configured to be disposed under said filling devices and to clean at least said filling devices; and said cleaning devices being disposed at intervals from one another around the periphery of said filling machine rotatable holding apparatus, wherein each of said set of cleaning devices is disposed between a corresponding pair of said openings;

said filling machine rotatable holding apparatus being configured to be rotated to position each of said openings under its corresponding filling device to permit said filling machine to receive, hold, and fill containers;

said filling machine rotatable holding apparatus being configured to be rotated to position each of said cleaning devices under its corresponding filling device to permit said cleaning devices to clean at least said filling devices; and said holding apparatus rotation arrangement being configured to rotate relative to said rotor and position said filling machine rotatable holding apparatus to electively position: each of said first set of openings under its corresponding filling device, and each of said cleaning devices under its corresponding filling device.

10. The container filling plant according to claim 9, wherein said filling machine rotatable holding apparatus is configured in the shape of a CIP-annular channel and/or media-channel, and/or takes up such a channel.

11. The container filling plant according to claim 10, wherein each of said set of cleaning devices of said filling machine comprises spray nozzles that also form inlet channels and outlet channels for further media or sterilizing media.

12. The container filling plant according to claim 9, wherein said closing machine comprises:

a rotor being configured and disposed to rotate about a central axis;

a plurality of closing devices for closing filled containers being disposed on and around the periphery of said rotor;

a rotatable, ring-shaped holding apparatus being configured to hold containers and position each container under a corresponding one of said closing devices at least during closing of the containers in said closing machine;

said closing machine rotatable holding apparatus being connected to and configured to rotate about the central axis of said rotor and with said rotor;

a holding apparatus rotation arrangement being configured to rotate and position said rotatable holding apparatus with respect to said closing devices;

said closing machine rotatable holding apparatus comprising:

openings being configured to hold and position containers;

said openings being disposed at intervals from one another around the periphery of said closing machine rotatable holding apparatus;

cleaning devices being configured to be disposed under said closing devices and to clean at least said closing devices; and said cleaning devices being disposed at intervals from one another around the periphery of said closing machine rotatable holding apparatus, wherein each of said set of cleaning devices is disposed between a corresponding pair of said openings;

said closing machine rotatable holding apparatus being configured to be rotated to position each of said openings under its corresponding closing device to permit said closing machine to receive, hold, and close containers;

said closing machine rotatable holding apparatus being configured to be rotated to position each of said cleaning devices under its corresponding closing device to permit said cleaning devices to clean at least said closing devices; and said holding apparatus rotation arrangement being configured to rotate relative to said rotor and position said closing machine rotatable holding apparatus to electively position: each of said first set of openings under its corresponding closing device, and each of said cleaning devices under its corresponding closing device.

13. The container filling plant according to claim 12, wherein said filling machine rotatable holding apparatus is configured in the shape of a CIP-annular channel and/or media-channel, and/or takes up such a channel.

14. The container filling plant according to claim 13, wherein each of said set of cleaning devices of said filling machine comprises spray nozzles that also form inlet channels and outlet channels for further media or sterilizing media.

15. The container filling plant according to claim 6, wherein said closing machine comprises:

a rotor being configured and disposed to rotate about a central axis;

a plurality of closing devices for closing filled containers being disposed on and around the periphery of said rotor;

a rotatable, ring-shaped holding apparatus being configured to hold containers and position each container under a corresponding one of said closing devices at least during closing of the containers in said closing machine;

said closing machine rotatable holding apparatus being connected to and configured to rotate about the central axis of said rotor and with said rotor;

a holding apparatus rotation arrangement being configured to rotate and position said rotatable holding apparatus with respect to said closing devices;

said closing machine rotatable holding apparatus comprising:

openings being configured to hold and position containers;

said openings being disposed at intervals from one another around the periphery of said closing machine rotatable holding apparatus;

cleaning devices being configured to be disposed under said closing devices and to clean at least said closing devices; and said cleaning devices being disposed at intervals from one another around the periphery of said closing machine rotatable holding apparatus, wherein each of said set of cleaning devices is disposed between a corresponding pair of said openings;

said closing machine rotatable holding apparatus being configured to be rotated to position each of said openings under its corresponding closing device to permit said closing machine to receive, hold, and close containers;

said closing machine rotatable holding apparatus being configured to be rotated to position each of said cleaning devices under its corresponding closing device to permit said cleaning devices to clean at least said closing devices; and said holding apparatus rotation arrangement being configured to rotate relative to said rotor and position said closing machine rotatable holding apparatus to electively position: each of said first set of openings under its corresponding closing device, and each of said cleaning devices under its corresponding closing device.

16. The container filling plant according to claim 15, wherein said filling machine rotatable holding apparatus is configured in the shape of a CIP-annular channel and/or media-channel, and/or takes up such a channel.

17. The container filling plant according to claim 16, wherein each of said set of cleaning devices of said filling machine comprises spray nozzles that also form inlet channels and outlet channels for further media or sterilizing media.

* * * * *